US006513301B1

(12) United States Patent
Snyder et al.

(10) Patent No.: US 6,513,301 B1
(45) Date of Patent: Feb. 4, 2003

(54) METHOD OF AND INSTRUMENT OR ARRANGEMENT FOR INSTALLING THERMAL INSULATION SHEETS IN CONFINED AREAS

(76) Inventors: Robert Snyder, 10 Adelphia Rd., Parsippany, NJ (US) 07054; Nancy Snyder, 10 Adelphia Rd., Parsippany, NJ (US) 07054

( * ) Notice: Subject to any disclaimer, the term of this patent is extended or adjusted under 35 U.S.C. 154(b) by 0 days.

(21) Appl. No.: 09/687,305

(22) Filed: Oct. 13, 2000

Related U.S. Application Data

(60) Provisional application No. 60/160,567, filed on Oct. 20, 1999.

(51) Int. Cl.[7] ..... E04B 1/00

(52) U.S. Cl. ..... 52/742.12; 52/742.1; 52/DIG. 1; 52/749.1; 294/61; 294/50; 294/50.5; 294/51

(58) Field of Search ..... 52/742.12, 742.1, 52/749.1, DIG. 1; 294/61, 50.9; 280/819

(56) References Cited

U.S. PATENT DOCUMENTS

| | | | | | |
|---|---|---|---|---|---|
| 1,158,943 | A | | 11/1915 | Louden | |
| 3,177,884 | A | * | 4/1965 | Thro | 135/54 |
| 3,204,974 | A | * | 9/1965 | McDonald | 280/11.37 |
| 5,054,983 | A | | 10/1991 | Froewis et al. | |
| 5,207,466 | A | * | 5/1993 | Ohlson | 294/61 |
| 5,370,433 | A | * | 12/1994 | Yost | 294/50.5 |
| 5,501,069 | A | * | 3/1996 | Lentz | 56/400.1 |
| 5,779,421 | A | | 7/1998 | Beck et al. | |
| 6,050,626 | A | * | 4/2000 | Dudley | 294/61 |

* cited by examiner

*Primary Examiner*—Carl D. Friedman
*Assistant Examiner*—Basil Katcheves
(74) *Attorney, Agent, or Firm*—Kirschstein et al.

(57) ABSTRACT

A thermal insulation sheet is maneuvered into position, especially in closely confined corners in an attic, by a tool having a prong which is inserted into the sheet, and a pusher surface which contacts the sheet to limit the depth of insertion of the prong, and which guides the sheet while an installer pushes the pusher surface against the sheet while maintaining the prong in the sheet.

5 Claims, 2 Drawing Sheets

10
14
20
34
A
30
12
32
2
36
2

22
30
36
A
20
18
14
16
24

30
32
38
36
44
40
42

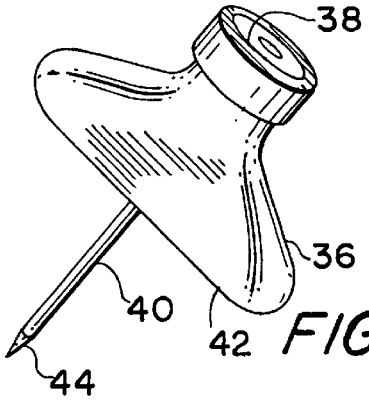
FIG.4
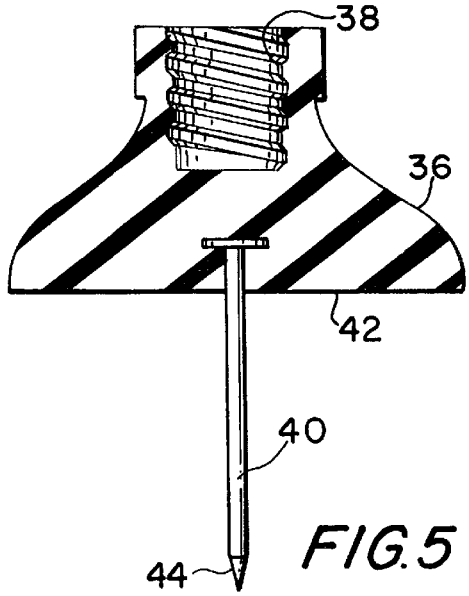
FIG.5
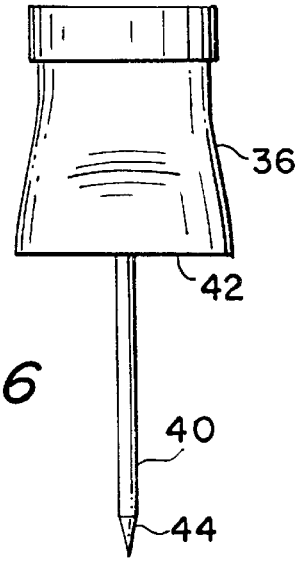
FIG.6
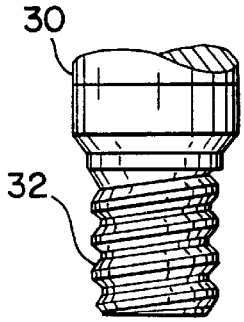
FIG.7
FIG.9
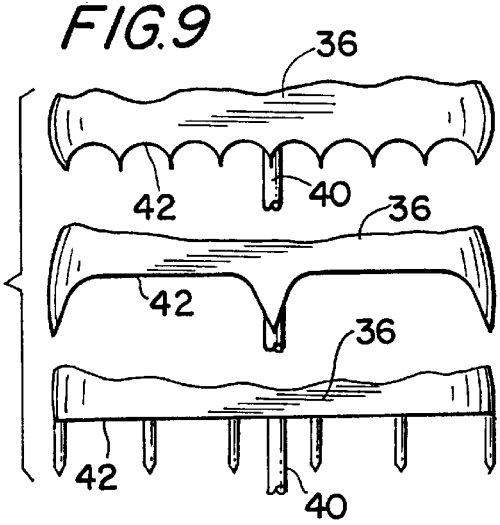
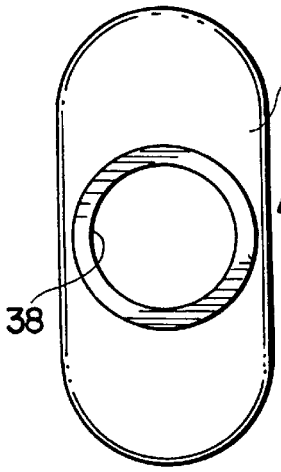
FIG.8

METHOD OF AND INSTRUMENT OR ARRANGEMENT FOR INSTALLING THERMAL INSULATION SHEETS IN CONFINED AREAS

CROSS REFERENCE TO RELATED APPLICATIONS

This application claims the priority of provisional application Ser. No. 60/160,567, filed Oct. 20, 1999.

BACKGROUND OF THE INVENTION

1. Field of the Invention

The present invention generally relates to a method of and an instrument or arrangement for installing thermal insulation sheets or rolls in confined and out-of-reach areas, especially corners in an attic having a low overhead and limited access.

2. Description of the Related Art

To prevent heat loss in a house, it is known to lay thermal insulation sheets between horizontal beams or joists extending across the floor of an attic. The sheets are comprised of a fibrous material and are manufactured in various thicknesses, e.g., on the order of 3 to 18 inches, rendering the sheets bulky. The bulky sheets are generally coiled in a roll precut into batts to simplify handling, and are unrolled in the attic to simplify installation.

The deployment of the rolled-up sheets is, however, not an easy task. An installer must stand or kneel on the beams, taking care not to step off into the spaces between the beams. The attic environment is typically hot and not well ventilated or lit. The fibrous material tends to shed, and the resulting dust, when inhaled, is injurious to the installer's health. All these installation difficulties are aggravated when the insulation is to be installed in the corners of the attic where the sloped rafters meet the beams at the eaves. The installer cannot stand due to the low overhead, and cannot reach his arms deeply into the corners. Further, the bulk of the fibrous sheets themselves make them difficult to push into these corners.

A novelty search of the art uncovered the following U.S. Patents: U.S. Pat. No. 1,158,943; U.S. Pat. No. 3,177,884; U.S. Pat. No. 5,054,983 and U.S. Pat. No. 5,779,421.

SUMMARY OF THE INVENTION

OBJECTS OF THE INVENTION

Accordingly, it is a general object of this invention to simplify the installation of thermal insulation sheets into confined areas, especially attic corners, and between ceilings and floors currently without insulation.

FEATURES OF THE INVENTION

In keeping with this object, one feature of this invention resides in a method of, and an instrument or arrangement for, installing a thermal insulation sheet into a confined area of low overhead and limited access. The invention comprises mounting a prong at an end of an elongated pole; holding an opposite end of the pole, and stabbing the prong into the sheet to be installed; and pushing the sheet, while maintaining the prong in the sheet, to maneuver the sheet into an installed position in the confined or out-of-reach area.

The use of the pole enables an installer to stand upright further away from the confined area, and to reach more deeply into the confined area than heretofore. The prong is mounted on a head that has a pusher surface. The pusher surface not only contacts the sheet to limit the depth of insertion of the prong into the sheet, but also guides the sheet into the installed position as the installer pushes the pusher surface against the sheet. A wide face of the pusher surface prevents the instrument from penetrating a faced or an unfaced sheet of insulation. A sloped rear surface of the head aids in removing the head in case of over penetration.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 is a perspective view of the head of the tool according to this invention;

FIG. 5 is a sectional view of the head of FIG. 4;

FIG. 6 is a side elevational view of the head of FIG. 4;

FIG. 7 is a side elevational view of a threaded end of a pole according to this invention;

FIG. 8 is a top plan view of the head of FIG. 4; and

FIG. 9 are broken-away, alternate side views of the pusher surface of the head of FIG. 4.

DETAILED DESCRIPTION OF THE PREFERRED EMBODIMENTS

Figure 1:
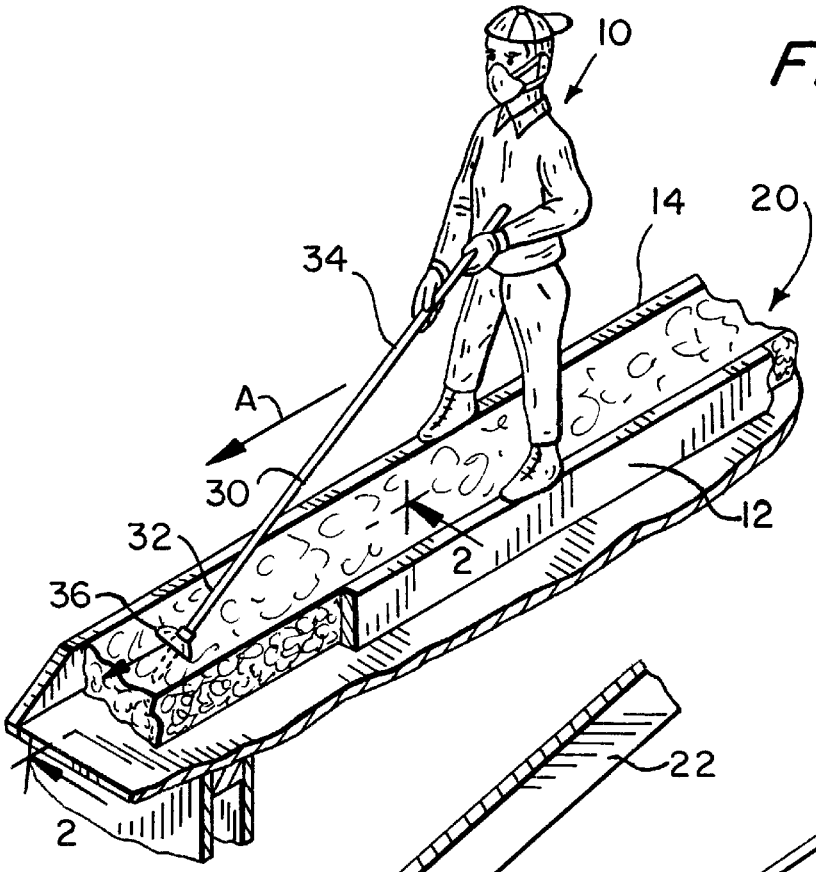
FIG. 1 is a perspective view of an installation during the performance of the method of this invention.

FIG. 1 depicts an installer 10 straddling a pair of attic joists or beams 12, 14 spaced apart by a centerline distance of 16 inches. A thermal insulation sheet 20 is being laid between the beams. The insulation sheet 20 is conventional, and includes a fibrous material 16, usually glass fibers, such as fiberglass, having a thickness on the order of 3–18 inches. The fibrous material usually has a backing or facing sheet 18 made of paper. One or more backing sheets may be used.

Figure 2:
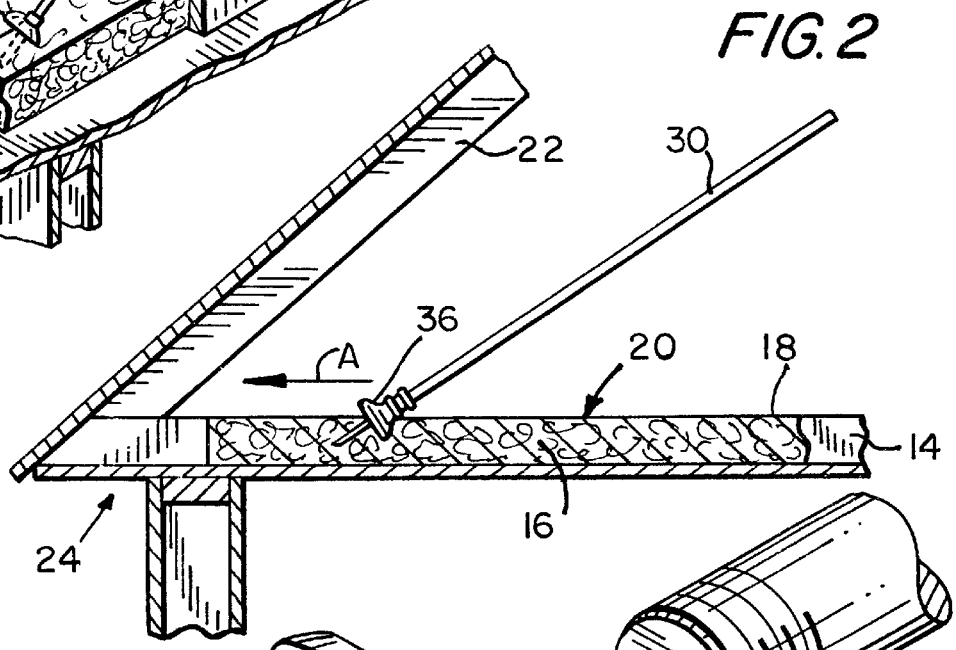
FIG. 2 is a broken-away, side view of an insulation sheet during its installation into an attic corner.

FIG. 2 depicts a corner of the attic at which a sloped roof rafter 22 meets a horizontal joist 14 at an overhang or eave 24. This attic comer is not high enough to allow the installer to stand upright on the joist 14 nor wide enough to allow the installer to position his or her body closer to an uninsulated area. Also, this comer is typically so deep that the installer cannot conveniently reach his outstretched arms fully therein. This low overhead and limited access make it difficult for the installer to place the insulation sheet 20 in this comer.

Figure 3:
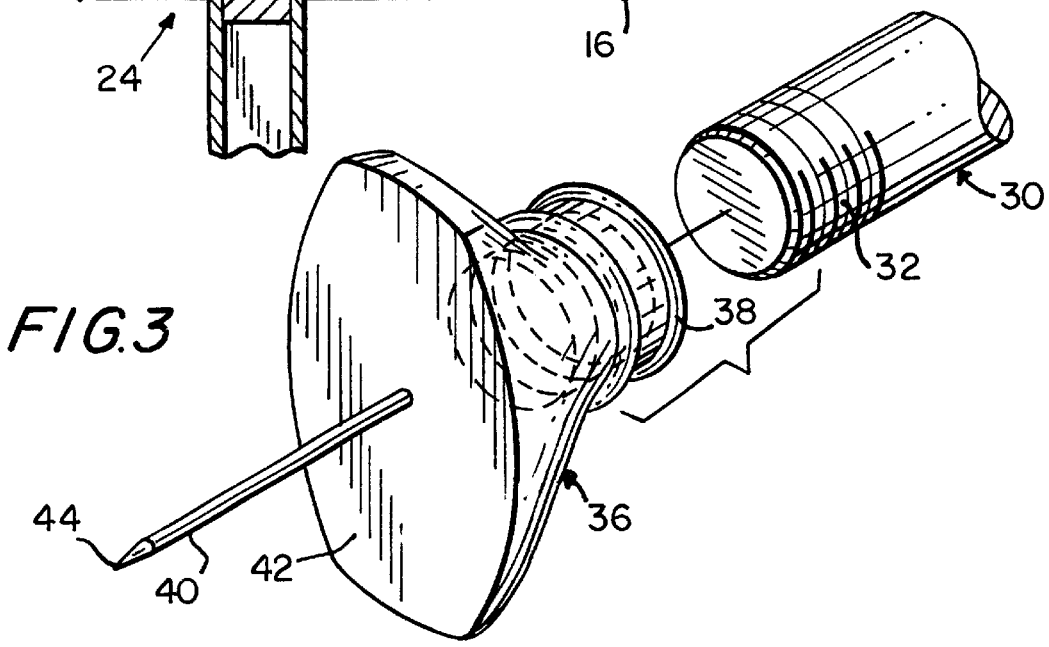
FIG. 3 is a broken-away, exploded, enlarged view of the installation tool according to this invention.

This invention proposes a tool or instrument for simplifying this installation. The tool includes an elongated pole 30, analogous to a broomstick, having a standard broomstick threaded end 32, as shown in FIG. 3 and FIG. 7. The installer holds the pole at its opposite unthreaded end 34.

The tool also includes a head 36 having a threaded bore or socket 38 (see FIGS. 4, 5 and 8) into which the threaded end 32 is received. The head 36 is constituted of a rigid material, such as a molded synthetic plastic material, wood, or metal. The head has a prong 40 projecting from a pusher surface 42 surrounding the prong. The prong has a sharp tip 44. The prong may be integral with the head and, for example, may be molded of a one-piece plastic, or the prong may be a separate piece, such as a metal nail that is molded within the plastic head. In the preferred embodiment shown in FIGS. 5 and 6, the prong is a two-inch common nail embedded in a plastic head.

Although only one prong is shown, it will be understood that a plurality of prongs of the same or different lengths could be employed. The pusher surface 42 need not be planar as shown, but could be roughened or provided with sharp projections as shown in the alternate views of FIG. 9.

According to this invention, the head 36 is mounted on the pole end 32 such that the prong 40 extends lengthwise of the pole. The installer stabs the prong 40 into the sheet 20 and holds it there. The prong easily pierces the paper backing 18 and the fibrous material 16 and stops when the pusher surface 42 contacts the backing 18. Thereupon, the installer maneuvers the pierced sheet in the direction of arrow A into the confined area. If the installer wishes to move the pierced sheet toward the right, then the installer will exert pressure on the left side of the pusher surface, and vice versa. The length of the pole enables the installer to stand further back from the corner than heretofore, and also enables the installer to reach more deeply into the corner than in the past where no such tool was used. A pole shorter in length enables the installer to insulate in more restrictive areas such as underneath floorboards and in crevices. The prong is easily removable from the sheet by pulling back on the pole. The installer may repeatedly stab the sheet at different locations to obtain a better leverage on the sheet and urge it to its desired position.

It will be understood that each of the elements described above, or two or more together, also may find a useful application in other types of constructions differing from the types described above.

While the invention has been illustrated and described as embodied in a method of and instrument or arrangement for installing thermal insulation sheets in confined areas, it is not intended to be limited to the details shown, since various modifications and structural changes may be made without departing in any way from the spirit of the present invention.

For example, rather than a single prong, a plurality of prongs in mutual parallelism can extend from the pusher surface. Also, rather than the head 36 being fixed in position relative to the pole 30, a ball and socket joint can be incorporated into the head so that the head can swivel relative to the pole.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims.

We claim:

1. A method of installing a thermal insulation sheet into a confined area of low overhead and limited access, comprising the steps of:

a) mounting a prong at one end region of an elongated pole;

b) holding an opposite end region of the pole, and stabbing the prong into the sheet to be installed; and c) pushing the sheet, while maintaining the prong in the sheet, to maneuver the sheet into an installed position in the confined area.

2. The method of claim 1, wherein the mounting step is performed by threading the one end region of the pole into a threaded bore formed in a head from which the prong extends.

3. The method of claim 2; and further comprising the step of integrally forming the head and the prong.

4. The method of claim 2; and further comprising the step of forming a pusher surface surrounding the prong, and wherein the stabbing step is performed until the pusher surface contacts the sheet.

5. The method of claim 1, wherein the holding and pushing steps are performed by an insulation installer working in an attic.

* * * * *